United States Patent [19]

Kwik

[11] Patent Number: 4,564,198

[45] Date of Patent: Jan. 14, 1986

[54] APPARATUS FOR USE IN PLAYING A BALL GAME

[76] Inventor: Tommy S. O. Kwik, No. 298A S. Bridge Rd., Singapore 0105, Singapore

[21] Appl. No.: 439,136

[22] Filed: Nov. 4, 1982

[30] Foreign Application Priority Data

Nov. 4, 1981 [GB] United Kingdom ..... 8133290

[51] Int. Cl.[4] ..... A63B 67/02

[52] U.S. Cl. ..... 273/176 F; 273/87.2; 273/87 C

[58] Field of Search ..... 273/411, 176 R, 176 E, 273/176 F, 176 FA, 176 FB, 87 R, 87 B, 87 C, 87 D, 87 E, 87.2, 87.4; 272/3

[56] References Cited

U.S. PATENT DOCUMENTS

| | | | |
|---|---|---|---|
| 1,627,517 | 5/1927 | Littleford, Jr. | 273/87.2 |
| 2,379,663 | 7/1945 | Smith | 273/176 FA |
| 3,844,558 | 10/1974 | Gigliotti | 273/87 R |
| 3,884,469 | 5/1975 | Morton | 273/87.2 |
| 4,095,793 | 6/1978 | Ray | 273/87 R |

*Primary Examiner*—William H. Grieb
*Attorney, Agent, or Firm*—Louis E. Marn

[57] ABSTRACT

Apparatus for use in playing a ball game, comprising a frame having a base and an upwardly extending perimeter wall which substantially defines the perimeter of the base. The base is provided with a plurality of apertures or holes capable of receiving a ball used to play the game and including at least one center aperture located adjacent the center of the base, with the other apertures being side apertures, which are located adjacent the perimeter wall. The base is provided with markings defining a plurality of areas each associated with a respective side aperture. Further markings may be provided in order to define further areas on the base. The areas defined by the markings are used for determining points to be awarded when playing the game. The inner surface of the perimeter wall is preferably cushioned. The game may be played with a conventional golf club and ball or with a specialized club and ball which are described. Further apparatus such as a screen starting device and guide putter may be used in combination with the frame.

10 Claims, 6 Drawing Figures

APPARATUS FOR USE IN PLAYING A BALL GAME

BACKGROUND OF THE INVENTION

Field of Invention

The present invention relates to apparatus for playing a ball game.

SUMMARY OF THE INVENTION

According to the present invention there is provided apparatus for playing a ball game comprising a frame having a base and an apwardly extending perimeter wall substantially defining the perimiter of the base, the base having a plurality of apertures capable of receiving a ball used to play the game and including at least one centre aperture located adjacent the centre of the base with the other apertures being side apertures which are located adjacent the perimeter wall, the base being provided with markings defining a plurality of areas each associated with a respective side aperture.

Advantageously, the base is rectangular and the number of side apertures is four, each side aperture being located adjacent the centre of a respective side of the base. Preferably, the markings define a set of three similar rectangular shaped but decreasingly sized areas associated with each respective side aperture. The base may be provided with additional markings which define areas interconnecting a respective one of the defined areas of each side aperture with the corresponding area of each of the other side apertures. Further markings may also be provided on the base. The further markings define an area which interconnects one set of corresponding areas from the defined areas associated with a pair of side apertures which are opposite to each other. The area defined by the further markings includes the centre aperture.

The areas defined by the markings on the base are used to award points when playing the game.

The inner side of the perimeter wall is advantageously provided with a resilient material so as to form a cushion which substantially surrounds the perimeter of the base. The apparatus for playing the game may include a screen positioned adjacent one side of the base and against which the ball used in playing the game is projected. The screen can advantageously be formed of a canvas material and may be provided with markings defining the areas to be used in awarding points when playing the game.

The apparatus is intended to be used in conjunction with a golf club or clubs and a golf ball. Alternatively, a specialised club and ball, similar to a golf club and golf ball may be provided for playing the game.

In addition to determining points to be awarded during play, the areas defined by the markings on the base may be used for determining the starting position for play between the apertures.

The apparatus for playing the game may additionally include a catapult device for launching the ball onto the base, either directly or by rebounding the ball from the screen, in order to initiate the game. The apparatus may also further include a ramp having a groove provided along the sloping surface thereof and for use in guiding the putting of the ball on the base of the frame.

BRIEF DESCRIPTION OF DRAWINGS

Embodiments of the present invention will now be described by way of example only and with reference to the accompanying drawings, in which.

DESCRIPTION OF THE PREFERRED EMBODIMENTS

Figure 2:
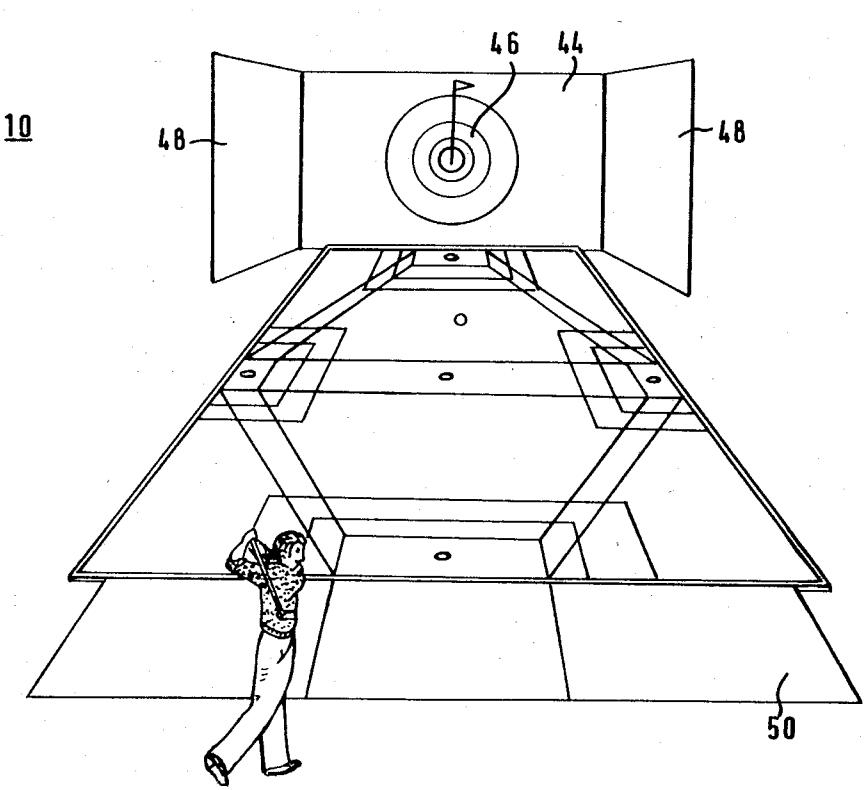
FIG. 2 is a perspective view of the frame shown in FIG. 1 together with additional apparatus for playing a variation of the game.
Figure 1:
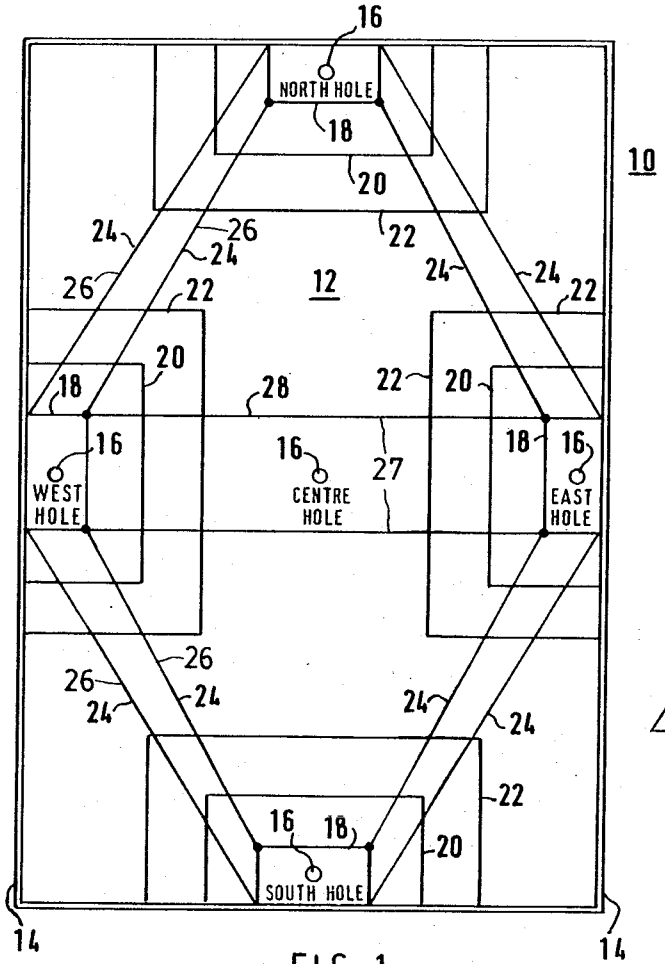
FIG. 1 is a plan view of the frame of the apparatus for playing a ball game.

As shown in FIGS. 1 and 2, the main apparatus for playing the ball game consists of the frame 10 which comprises a rectangular base 12 and an upright perimeter wall 14. The perimeter wall 14 defines the perimeter of the base 12. The base 12 is provided with five apertures or holes 16 for receiving the ball used to play the game. Of the five holes 16, four are located adjacent the perimeter wall 14 and centrally of a respective side of the base 12. These four apertures or holes 16 are referred to hereinafter as the side holes 16. The fifth hole 16 is located at the centre of the base 12 and is referred to as the centre hole 16.

The base 12 is provided with a series of markings which may be used as a basis for awarding points whilst playing the game. The markings also define the location from which play between holes 16 is to be commenced. The markings consist of a respective series of three rectangles 18, 20, 22 associated with each of the side holes 16. The rectangles 18, 20 and 22, defined by the respective markings, are of similar shape to each other but are arranged in decreasing size. The smallest rectangle, rectangle 18, of each series of rectangles is positioned with the respective side hole at its centre and with one side of the rectangle 18 replaced by a portion of the perimeter wall 14. The intermediate rectangle, rectangle 20, and the largest rectangle, rectangle 22, of each set also have one respective side replaced by corresponding portions of the perimeter wall 14. The large rectangle 22 and the intermediate rectangle 20 of each set are arranged symetrically with respect to the small rectangle 18 of that set. Additional markings 24 are provided on the base and these markings 24 interconnect the two corners of either end of each small rectangle 18 with the closest pair of corners of the other small rectangles 18. Thus, four trapezia 26 are defined which together with the small rectangles 18 define an octagon. Further markings 27 which are parallel to one pair of sides of the base 12 define a further rectangle 28. The rectangle 28 has two sides formed by one side each from a pair of opposite small rectangles 18 and the remaining two sides of the rectangle 28 can be considered as extensions of the remaining two sides of the specified small rectangles 18. The centre hole 16 is located at the centre of the rectangle 28.

The frame 10 has the following dimensions; length 475 cm. (15 feet), width 305 cm. (10 feet); height of perimeter wall 14, 10 cm. (4 inches); length of small rectangle 18, 61 cm. (2 feet); width of small rectangle 18, 30.5 cm. (1 foot); length of intermediate rectangle 20, 99 cm. (3 feet 3 inches); width of intermediate rectangle 20, 61 cm. (2 feet); length of large rectangle 22, 167.5 cm. (5 foot 6 inches); width of large rectangle 22, 91.5 cm. (3 feet).

The inner surface of the perimeter wall 14 is provided with a rubber cushion (not shown) for the first 5 cm. (2 inches) above the base 12.

The ball game is started from a position adjacent one end of the frame 10 and for ease of description in the rules of the game, the side hole 16 adjacent the side of the frame from which the game is commenced is termed the South hole and the remaining side holes 16 are termed the North, East and West holes respectively.

Figure 3A:
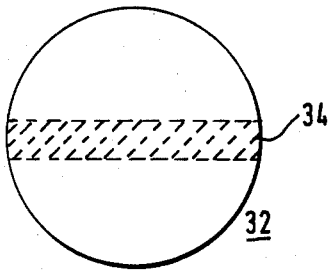
FIG. 3 illustrates a specialised ball and club for playing the game, to an enlarged scale compared with FIGS. 1 and 2.
Figure 3B:
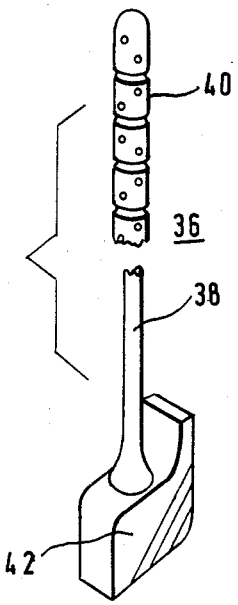

The game can either be played using a conventional golf ball and clubs or can be played using the specialised ball 32 and club 36 illustrated in FIG. 3. The ball 32 has a diameter of 4.5 cm. ($1\frac{3}{4}$ inches) and a weight of approximately 0.35 kg. The ball 32 has a 6 mm. ($\frac{1}{4}$ inch) steel bar 34 located along one diameter, the remainder of the ball 32 being formed of wood. The club 36 comprises a shaft 38 having a handle 40 at one end and a head 42 at the other. The head 42 is formed of a square plate having a depth equal to half of the length of a side of the plate. A portion is removed from the top left hand corner of the plate and the removed portion extends for $\frac{3}{4}$ of the length of the top side of the plate, for a $\frac{1}{4}$ of the length of the vertical side and across the full depth of the plate. The shaft 38 is attached to the head 42 at the centre of the larger top surface of the plate. The length of one side of the square plate is 8 cm. ($3\frac{1}{4}$ inches), the overall length of the club 36 is 105 cm. (3 feet $5\frac{1}{2}$ inches) and the diameter of the shaft 38 is 2.5 cm. (1 inch). The club 36 is substantially formed of wood.

The apparatus for playing the game may optionally include a screen 44 which is positioned along the side of the base 12 associated with the North hole 16. In commencing the game, the ball is projected against the screen and after having struck the screen the ball falls onto the base 12 and can then be played towards the holes 16. The screen 44 is made of a canvas material and is provided with concentric circular markings 46 which are used for awarding points at the beginning of the game. The screen 44 is provided with side extensions 48 which extend along side edges of the frame 10 in order to provide a safety feature if the trajectory of the ball passes over the East or West rather than the North side of the base 12. If the ball used to play the game is driven against the screen 44 using a conventional golf action, then sloping platforms 50 may be placed along the South edge of the frame 10 in order to facilitate the introduction of the ball into the frame 10.

Figure 4:
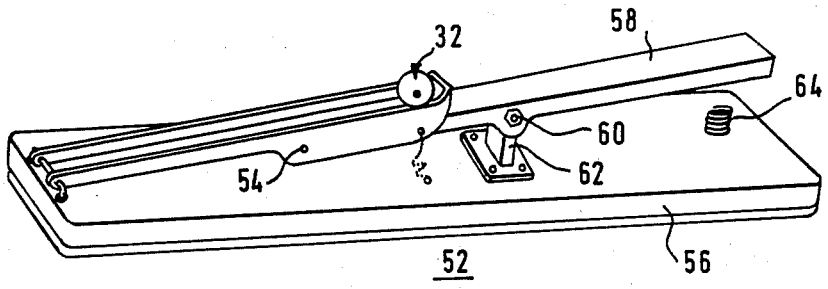
FIG. 4 illustrates an additional piece of apparatus for initiating the game, drawn to an independent scale.

An alternative method of introducing the ball into the frame 10 to commence play is provided by the starting device 52 illustrated in FIG. 4. The starting device 52 can be employed with particular advantage when the specialised ball 32 and club 36 are used in playing the game. The starting device 52 comprises an elongate projector 54 which is pivotally attached at one end to a base 56, and an elongate striker 58 which is supported at its centre by a pivot 60 which extends transversely of the striker 58. The pivot 60 is provided at the top of a pillar 62 which is secured to the base 56. One end of the striker 58 extends beneath the free end of the projector 54 and a spring 64, attached to the base 56, is provided beneath the other end of the striker 58. The free end of the projector 54 is shaped so as to receive the ball 32. The spring end of the striker 58 is propelled downwards by being struck with the club 36 and thus the free end of the projector 54 is forced upwards thus propelling the ball 32 into the frame 10 or onto the canvas 44. The spring 64 retards the motion of the striker 58 once the projector 54 has been propelled upwards. The length of the base 56 is 122 cm. (4 feet), the distance between the pivot 60 and the extreme of the spring end of the striker 58 is 40 cm. (1 foot 4 inches), the widths of the projector 54 and the striker 58 are approximately 5 cm. (2 inches) and in the illustrated loaded condition the spring end of the striker 58 is held 19 cm. (8 inches) above the end of the base 56.

Figure 5:
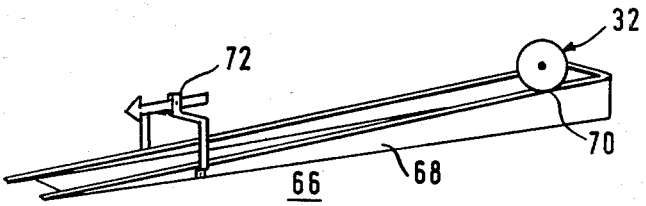
FIG. 5 illustrates a putting guide which is an additional piece of apparatus for playing the game and which is also drawn to an independent scale.

An additional piece of apparatus which may optionally be used in playing the game is the guide putter 66 illustrated in FIG. 5. The guide putter 66 comprises a shallow ramp 68 which is provided towards the top end of its sloping surface with an indentation 70 in which the ball 32 is placed. Towards the lower end of the ramp 66 there is provided a direction indicator 72 which facilitates alignment with the direction required for the ball. A light stroke with the club 36 moves the ball 32 out of the indentation 70 and the ball then rolls down the ramp 66 in the required direction. The width of the ramp 66 is approximately 2.5 cm. (1 inch), the height of the ramp adjacent the indentation 70 is 10 cm. (4 inches) and the length of the guide putter is 61 cm. (2 feet).

A description of various methods of playing the game will now be given.

The game is played by two or more players and begins with each player propelling a ball 32 into the frame 10. The starting point can be located at any agreed distance from the frame 10. Once the ball 32 has entered the frame 10 the player begins to play the first hole, which is the North hole 16. After he has played the North hole 16, the next player plays his hole by first landing his ball inside the frame 10. After all the players have finished playing the first hole 16, the first player starts to play the second hole which is the South hole 16 and the game then continues in this manner. The winner is the player who has taken the least number of strokes, as may be recorded on a scoreboard, to complete the game. The details of the game has many variations from this basic description.

In one variation, the player must hit the ball 32 from the starter 52 onto the screen 44 placed behind the frame 10 before the ball 32 drops into the frame 10. The screen 44 is provided with a bullseye on which points (strokes) can be scored. A centre bullseye may be awarded four points (that is minus 4 strokes) with the score allocated becoming lower as the ball strikes off centre of the target 46 on the screen 44.

In one variation of the game known as "double cushion play", the players may score extra points with double-cushioning. That is, the ball is required to rebound from two cushioned sides of the frame 10 before rolling into the hole 16 of play.

The game may be played with extra points (a reduction in the number of strokes taken) being awarded in dependence opon the location of the ball when it first lands in the frame 10 from the starter 52. For example, if the ball lands in a small rectangle 18 five points will be awarded, if it lands in an intermediate rectangle 20 four points will be awarded, if the ball lands in a large rectangle 22 three points will be awarded, if the ball lands in one of the trapezia 24 two points will be awarded and if the ball lands in the rectangle 28 one point will be awarded.

In order to score points by playing the ball 32 into a hole 16, the player must let the ball cushion, that is hit the rubber side wall, before the ball 32 rolls into the hole of play. The first hole of play is the North hole followed by the South hole, the East hole and the West hole. The last hole of play is the centre hole which is the only hole that the ball can roll directly into in order to score without cushioning. When all five holes have been played, a player is said to have finished playing a set. The players should agree before beginning the game on the total number of sets they wish to play. The player using the least number of strokes wins the set and the player winning the most sets wins the game. A player may use the guide putter 66 at any stage of play between the holes 16. A player begins to play the next hole from either one of two corner points of the small rectangle 18 associated with the hole 16 which has just been played. Should the ball fail to hit the cushion and roll straight into the hole, the player has a penalty stroke added to his total. Play then resumes at one of the two corners of the small rectangle 18 of play and continues until the ball has been successfully knocked into the hole. If the ball rolls into the wrong hole of play, the player has a penalty stroke added to his total and if this situation occurs before the ball has been successfully knocked into the North hole the player not only gains a penalty stroke but must also restart his game at one of the two Restart Approach Points situated at right-angles to the corner of the lower frame and 2.5 meters away from them. The players must decide before beginning to play whether or not the ball must strike the screen 44 before dropping into the frame 10.

It is envisaged that this game may be played both indoors and outdoors.

What I claim is:

1. Apparatus for playing a ball game comprising a frame having a base and an upwardly extending perimeter wall substantially defining the perimeter of the base, the base having a plurality of means each defining a respective aperture capable of receiving a ball used to play the game and including at least one means defining a centre aperture located adjacent the centre of the base with the other apertures being side apertures which are located adjacent the perimeter wall, the base being provided with markings defining a set of three similar rectangularly-shaped areas of decreasing size each associated with a respective side aperture.

2. Apparatus as claimed in claim 1, wherein the base is rectangularly-shaped and the number of side apertures is four, each side aperture being located adjacent the centre of a respective side of the base.

3. Apparatus as claimed in claim 1, wherein the base is provided with additional marking which define areas interconnecting a respective one of the defined areas of each side aperture with the corresponding area of each of the other side apertures.

4. Apparatus as claimed in claim 3, wherein the further markings define an area which interconnects one set of corresponding areas from the defined areas associated with a pair of side apertures which are opposite to each other, said interconnecting area surrounding the centre aperture.

5. Apparatus as claimed in claim 1, wherein the inner surface of the perimeter wall is provided with a resilient material so as to form a cushion which substantially surrounds the perimeter of the base.

6. Apparatus as claimed in claim 1, in combination with a screen.

7. Apparatus as claimed in claim 1, in combination with a club.

8. Apparatus as claimed in claim 1, in combination with a ball.

9. Apparatus as claimed in claim 1, in combination with a catapult device for launching a ball.

10. Apparatus as claimed in claim 1, in cmbination with a guide putter.

* * * * *